US006883797B2

(12) United States Patent
Guddanti et al.

(10) Patent No.: US 6,883,797 B2
(45) Date of Patent: Apr. 26, 2005

(54) SWAPPING FEED AND SEPARATION ROLLERS

(75) Inventors: Srinivas Guddanti, Boise, ID (US); Chet M. Butikofer, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 319 days.

(21) Appl. No.: 10/138,884

(22) Filed: May 3, 2002

(65) Prior Publication Data

US 2003/0205862 A1 Nov. 6, 2003

(51) Int. Cl.[7] ..... B65H 3/52
(52) U.S. Cl. ..... 271/122
(58) Field of Search ..... 271/122, 109, 271/125, 104, 121, 137; 221/277; 198/622, 624, 782; B65H 3/06, 3/52, 3/34

(56) References Cited

U.S. PATENT DOCUMENTS 1,728,538 A * 9/1929 Gentile et al. ..... 198/782
2,434,411 A * 1/1948 Johnson ..... 198/782
4,348,019 A 9/1982 Stievenart et al.
5,120,297 A * 6/1992 Adami ..... 493/355
5,312,098 A 5/1994 Inoue
5,421,569 A * 6/1995 Davidson ..... 271/109

FOREIGN PATENT DOCUMENTS

EP 1220047 7/2002
JP 9-118444 * 5/1997 ..... B65H/3/06

* cited by examiner

*Primary Examiner*—Donald P. Walsh
*Assistant Examiner*—Kenneth Bower

(57) ABSTRACT

A sheet feeding system has a pick roller, a first roller, and a second roller. The ends of the first and second rollers are coupled together. The pick roller acquires, or picks, a sheet from a stack of sheets and passes the sheet to the first and second rollers. One of the first and second rollers discourages unintended sheets passed with the sheet picked from the stack. The other of the first and second rollers advances the sheet. A logic processor evaluates interchange conditions and activates a drive mechanism when the evaluated interchange conditions reaches a threshold value. The drive mechanism interchanges the first and second rollers so that the second roller becomes the first roller and the first roller becomes the second roller.

21 Claims, 3 Drawing Sheets

SWAPPING FEED AND SEPARATION ROLLERS

FIELD OF THE INVENTION

This invention relates in general to sheet feeding technology and, more particularly, to interchanging separator rollers and feed rollers in a sheet feeder.

BACKGROUND OF THE INVENTION

A sheet feeder retrieves a single sheet from a stack of sheets and provides the single sheet to a device. Examples of devices that utilize sheet feeders include printers, copiers, scanners, facsimile machines, and multifunction devices.

One example of a conventional sheet feeder includes three rollers that cooperate to carry out the function of the sheet feeder. The three rollers are often referred to as pick, feed, and separator rollers. The pick roller contacts one of the sheets in a stack of sheets and rotates to urge the contacted sheet between the feed and separator rollers. Occasionally, the contacted sheet adheres to an adjacent sheet and both sheets move towards the feed and separator rollers.

The feed roller rotates to advance the contacted sheet. The separator roller rotates in a direction opposite the feed roller to help prevent an adhering sheet from being advanced with the contacted sheet. The contacted sheet advances against the rotation of the separator roller until the torque reaches a threshold. Then, the separator roller reverses direction. This action causes the separator roller to wear at a greater rate than the pick and feed rollers. Consequently, the separator roller must be replaced more frequently than the pick and feed rollers.

SUMMARY OF THE INVENTION

According to principles of the present invention, a sheet feeding system has a pick roller, a separator roller, and a feed roller. The ends of the separator and feed rollers are coupled together. The pick roller acquires, or picks, a sheet from a stack of sheets and passes the sheet to the separator and feeder roller. The separator roller discourages unintended sheets passed with the sheet picked from the stack. The feed roller advances the sheet. A logic processor evaluates interchange conditions and activates a drive mechanism when the interchange conditions meet interchange criteria. The drive mechanism interchanges the separator roller and the feed roller so that the separator roller becomes the feed roller and the feed roller becomes the separator roller.

According to further principles of the present invention, the drive mechanism includes either a rotatable shaft axially parallel to the first and second rollers and coupled to one of the first and second ends and a shaft driver configured to rotate the shaft or a toothed wheel gear coupled to one of the first and second ends and a gear driver configured to drive the gear, rotating the system.

DETAILED DESCRIPTION OF THE INVENTION

Figure 1:
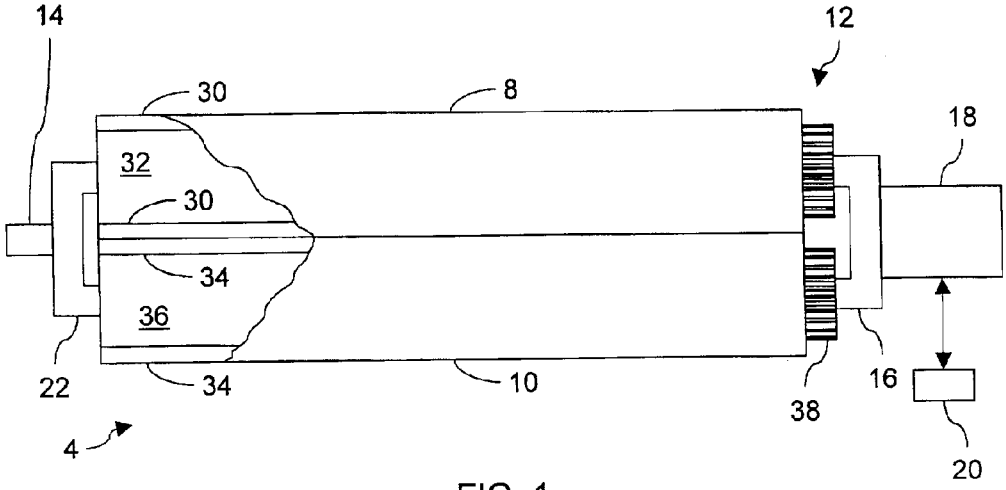
FIG. 1 is diagrammatical, partially cut away, front elevation representing one embodiment of the feed and separator rollers of the present invention.
Figure 2:
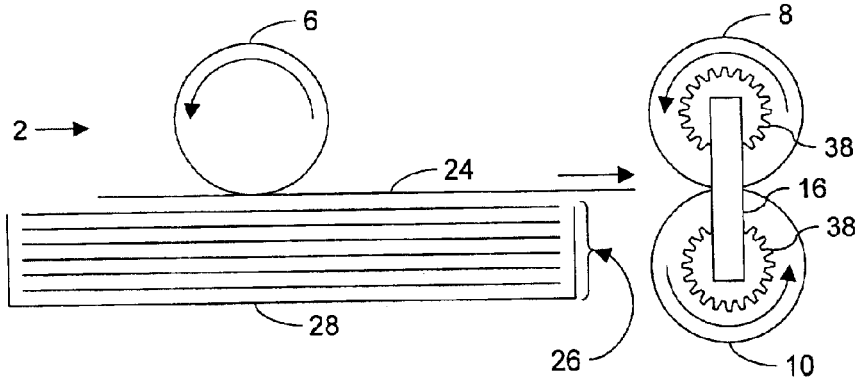
FIG. 2 is diagrammatical side elevation representing one embodiment of a sheet feeding system of the present invention with the feed and separator rollers of FIG. 1.

Illustrated in FIGS. 1 and 2 is one embodiment of a sheet feeding system 2 of the present invention. Sheet feeding system 2 includes combination 4 and pick roller 6. Combination 4 includes feed roller 8, separator roller 10, roller driver 12, coupling 16, drive mechanism 18, and optionally, coupling 14, logic processor 20 and pivot shaft 22.

Pick roller 6 is any one or more rotatable, generally cylindrically shaped rolling objects configured to frictionally contact one sheet 24 from a stack of sheets 26 and, by rolling, urge sheet 24 towards feed roller 8 and separator roller 10. For clarity, contacting sheet 24 and urging sheet 24 towards feed roller 8 and separator roller 10 will be referred to as picking. In one embodiment, stack of sheets 26 reside in a sheet bin, cartridge, or tray 28 until picked by pick roller 6.

Feed roller 8 is any one or more rotatable, generally cylindrically shaped, rolling objects configured to receive and frictionally contact sheet 24 and, by rolling, advance sheet 24 between feed roller 8 and separator roller 10 to a device or system (not shown). Examples of devices or systems to which feed roller 8 advances sheet 24 include printers, copiers, scanners, facsimile machines, and multifunction devices.

Feed roller 8 includes a rolling surface 30 and an inner core 32. Rolling surface 30 may be of the same or a different material than inner core 32. Rolling surface 30 and inner core 32 may be unitary or separate.

Separator roller 10 is any one or more rotatable, generally cylindrically shaped, rolling objects configured to receive and frictionally contact sheet 24 and, by rolling, discourage any of the sheets of stack 26 from advancing with sheet 24 to the device or system. Separator roller 10 is substantially parallel to feed roller 8. Separator roller 10 rolls or rotates in a direction opposite feed roller 8.

Separator roller 10 includes a rolling surface 34 and an inner core 36. Rolling surface 34 may be of the same or a different material than inner core 36. Rolling surface 34 and inner core 36 may be unitary or separate. Rolling surface 34 is adjacent rolling surface 30.

In one embodiment, feed roller 8 and separator roller 10 extend only a portion of the way across a sheet pathway and are unsupported at one end. In this embodiment, coupling 14 and pivot shaft 22 are not present. In an alternate embodiment, feed roller 8 and separator roller 10 extend entirely across the sheet pathway and are supported at both ends. In this embodiment, coupling 14 and pivot shaft 22 are present.

Roller driver 12 is any apparatus or system for rotating feed roller 8 and separator roller 10. In one embodiment, roller driver 12 includes two toothed wheel gears 38. One gear 38 is affixed to feed roller 8 and the other gear 38 is affixed to separator roller 10.

Couplings 14, 16 are any mechanism connecting an end of feed roller 8 to an end of separator roller 10. Each coupling 14, 16 connects one set of ends of feed roller 8 and separator roller 10.

Drive mechanism 18 is any apparatus or system configured to rotate combination 4 and interchange, in position, feed roller 8 and separator roller 10. Once interchanged, feed roller 8 becomes separator roller 10 and separator roller 10 becomes feed roller 8. In one embodiment, drive mechanism 18 is controlled by logic processor 20. Drive mechanism 18 may be on the same ends of feed roller 8 and separator roller 10 as roller driver 12 or on opposite ends of feed roller 8 and separator roller 10 as roller driver 12.

In one embodiment, drive mechanism 18 and couplings 14, 16 are sized and shaped so that feed roller 8 and separation roller 10 are centered within a sheet path. In alternate embodiments, drive mechanism 18 and couplings 14, 16 are sized and shaped so that feed roller 8 and separation roller 10 are located in any position across a sheet path.

Logic processor 20 is any apparatus or system configured to evaluate interchange conditions and to control drive mechanism 18. Interchange conditions are any conditions useful for determining whether to interchange feed roller 8 and separator roller 10. Examples of interchange conditions include number of sheets advanced by feed roller 8 and number of print jobs during which feed roller 8 advances sheets. In one embodiment, logic processor 20 is further configured to vary the interchange criteria that must be met by the interchange conditions before activating drive mechanism 18.

Pivot shaft 22 extends from one of the couplings 14, 16 opposite drive mechanism 18. Pivot shaft 22 is rotatably mounted in a position to provide a point of rotation for combination 4 to interchange feed roller 8 and separator roller 10.

Figure 3:
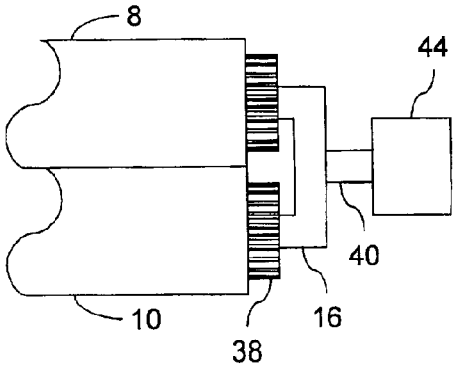
FIG. 3 is diagrammatical, front elevation representing one embodiment of the drive mechanism of FIG. 1.
Figure 4:
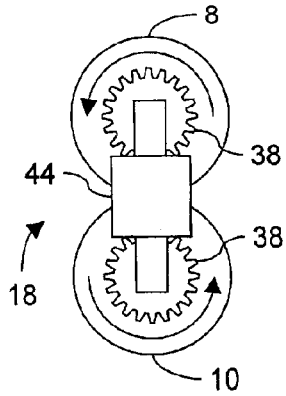
FIG. 4 is diagrammatical side elevation representing the drive mechanism of FIG. 3.

Illustrated in FIGS. 3 and 4 are one embodiment of drive mechanism 18. Drive mechanism 18 includes shaft 40 and shaft driver 44. Shaft driver 44 extends from or is attached to one of couplings 14, 16. Shaft driver 44 rotates shaft 40 that rotates combination 4 and interchanges, in position, feed roller 8 and separator roller 10.

Figure 5:
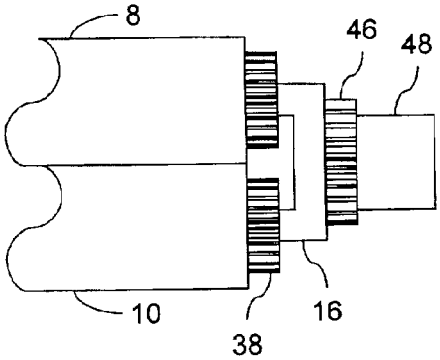
FIG. 5 is diagrammatical, front elevation representing an alternate embodiment of the drive mechanism of FIG. 1.
Figure 6:
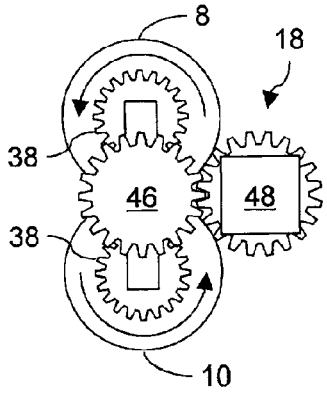
FIG. 6 is diagrammatical side elevation representing the drive mechanism of FIG. 5.

Illustrated in FIGS. 5 and 6 are an alternate embodiment of drive mechanism 18. Drive mechanism 18 includes toothed wheel gear 46 and gear driver 48. Toothed wheel gear 46 extends from or is attached to one of couplings 14, 16. Gear driver 48 rotates gear 46 that rotates combination 4 and interchanges, in position, feed roller 8 and separator roller 10.

Figure 7:
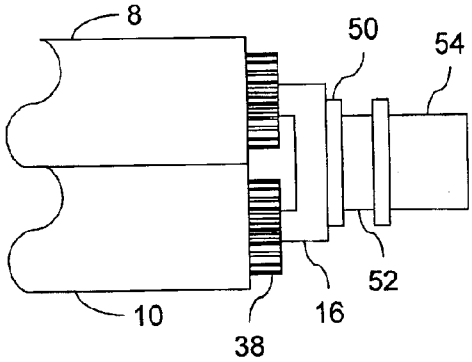
FIG. 7 is diagrammatical, front elevation representing another alternate embodiment of the drive mechanism of FIG. 1.
Figure 8:
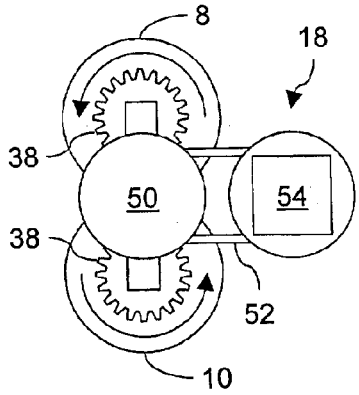
FIG. 8 is diagrammatical side elevation representing the drive mechanism of FIG. 7.

Illustrated in FIGS. 7 and 8 are another alternate embodiment of drive mechanism 18. Drive mechanism 18 includes pulley wheel 50, belt 52, and belt driver 54. Pulley wheel 50 extends from or is attached to one of couplings 14, 16. Belt 52 interconnects pulley wheel 50 and belt driver 54. Belt driver 54 rotates pulley wheel 50 that rotates combination 4 and interchanges, in position, feed roller 8 and separator roller 10.

Figure 9:
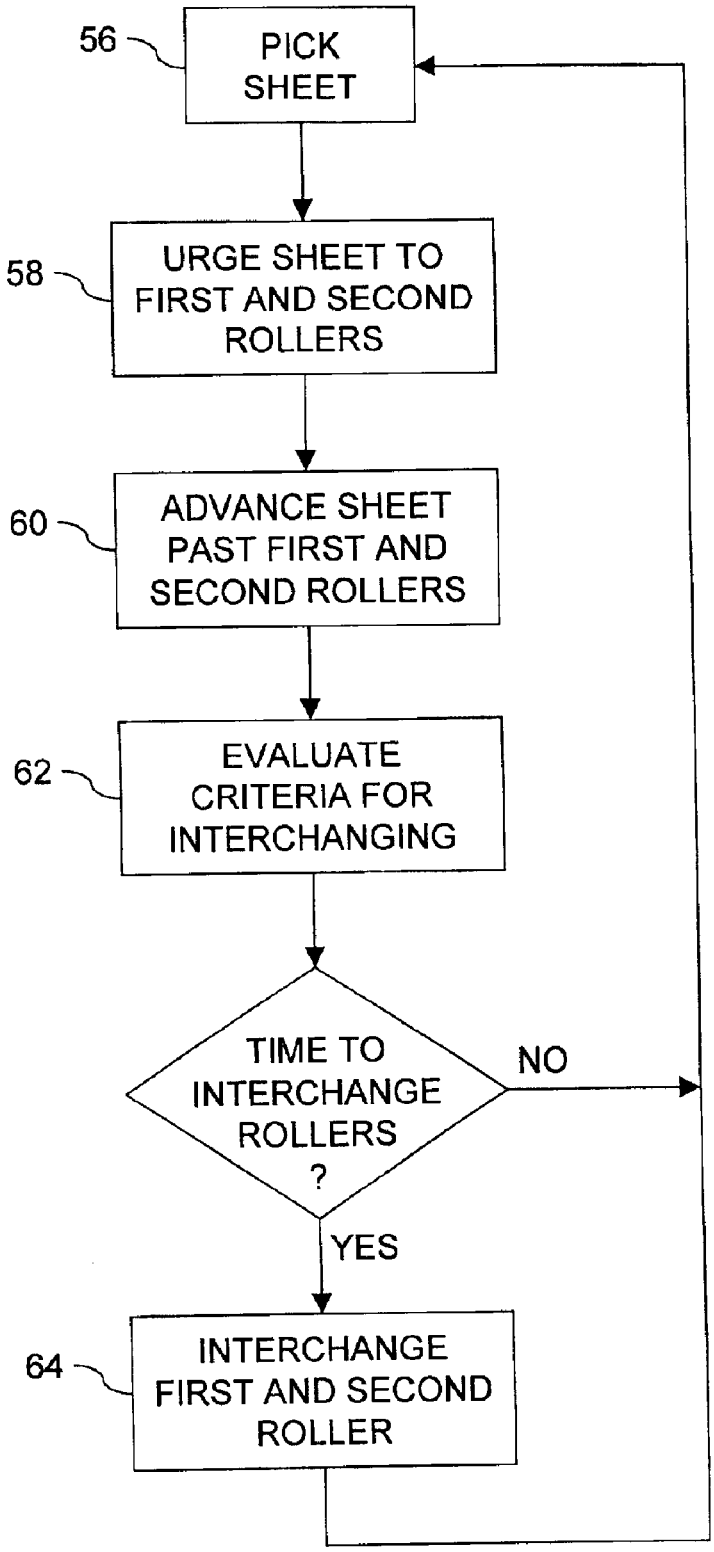
FIG. 9 is a flow chart illustrating one embodiment of the method of the present invention for preserving a feed and separator roller combination.

FIG. 9 is a flow chart representing steps of one embodiment of the present invention. Although the steps represented in FIG. 9 are presented in a specific order, the present invention encompasses variations in the order of steps. Furthermore, additional steps may be executed between the steps illustrated in FIG. 9 without departing from the scope of the present invention.

Feed roller 8 and separator roller 10 are interchangeable. Since feed roller 8 and separator roller 10 are interchangeable, they are alternatively referred to as first roller and second roller. Either feed roller 8 or separator roller 10 may be referred to as first roller and either may be referred to as second roller.

Sheet 24 is picked 56 and urged 58 between first and second rollers. One of the first and second rollers rotates to advance 60 sheet 24 while the other of the first and second rollers rotates to discourage additional sheets from stack 26 from advancing with sheet 24.

Criteria for interchanging first and second rollers are evaluated 62. In one embodiment, evaluating 62 criteria for interchanging includes counting the pages advanced 60 by the first and second rollers. In an alternate embodiment, evaluating 62 criteria for interchanging includes measuring the sheet slippage of sheet 24 as sheet 24 is advanced 60 and comparing the sheet slippage to a slippage threshold.

If the evaluated criteria for interchanging indicate no interchange of first and second rollers is desirable, the process repeats until an interchange of first and second rollers is desirable. If the evaluated interchange conditions indicates an interchange of first and second rollers is desirable, second roller is interchanged 64 for first roller and first roller is interchanged 64 for second roller. An interchange of first and second rollers may be desirable upon any desired condition. Examples of desired conditions include after a desired number of print jobs, after a desired number of pages, and after an equal number of pages have been advance since a previous interchange.

In one embodiment, interchanging 64 the rollers includes activating shaft driver 44 to rotate shaft 42 and shaft 42 rotating combination 4 to interchange the first and second rollers.

In an alternate embodiment, interchanging 64 the rollers includes activating gear driver 48 to rotate gear 46 and gear 46 rotating combination 4 to interchange the first and second rollers.

In another alternate embodiment, interchanging 64 the rollers includes activating belt driver 54 to rotate pulley 50 and pulley 50 rotating combination 4 to interchange the first and second rollers.

The process may be repeated as many times as desired. In one embodiment, the process is repeated until rolling surface 30 or rolling surface 34 has worn so that it no longer functions properly.

The foregoing description is only illustrative of the invention. Various alternatives and modifications can be devised by those skilled in the art without departing from the invention. Accordingly, the present invention embraces all such alternatives, modifications, and variances that fall within the scope of the appended claims.

What is claimed is:

1. A sheet feeding system comprising:

(a) first and second parallel rotatable rollers each having first and second ends, the first ends coupled together; and, (b) a drive mechanism configured to interchange, in position, the first roller for the second roller and the second roller for the first roller.

2. The sheet feeding system of claim 1 wherein the drive mechanism includes:

(a) a rotatable shaft axially parallel to the first and second rollers and coupled to one of the first and second ends; and, (b) a shaft driver configured to rotate the shaft, interchanging, in position, the first roller for the second roller and the second roller for the first roller.

3. The sheet feeding system of claim 1 wherein the drive mechanism includes:

(a) a toothed wheel gear coupled to one of the first and second ends; and, (b) a gear driver configured to drive the gear, interchanging, in position, the first roller for the second roller and the second roller for the first roller.

4. The sheet feeding system of claim 1 wherein the drive mechanism includes:

(a) a pulley wheel coupled to one of the first and second ends;

(b) a belt driver configured to drive the pully wheel, interchanging, in position, the first roller for the second roller and the second roller for the first roller; and, (c) a belt interconnecting the pulley wheel and the belt driver.

5. The sheet feeding system of claim 1 further including a logic processor configured to activate the drive mechanism to interchange, in position, the first roller for the second roller and the second roller for the first roller.

6. The sheet feeding system of claim 1 further including a roller driver for rotating the rollers.

7. The sheet feeding system of claim 1 wherein each of the first and second rollers includes a rolling surface, each rolling surface adjacent the other rolling surface.

8. A method for distributing wear in a sheet feeding system, the method comprising:

(a) picking a sheet;

(b) urging the sheet to first and second parallel rotatable rollers;

(c) rotating one of the first and second rollers to advance the sheet;

(d) evaluating criteria for interchanging the first and second rollers; and, (e) responsive to the criteria for interchanging, interchanging the second roller for the first roller and the first roller for the second roller.

9. The method of claim 8 wherein interchanging the first and second rollers includes:

(a) activating a shaft driver to rotate a shaft; and, (b) the shaft rotating the first and second rollers to interchange the first and second rollers.

10. The method of claim 8 wherein interchanging the first and second rollers includes:

(a) activating a gear driver to rotate a toothed wheel gear; and, (b) the toothed wheel gear rotating the first and second rollers to interchange the first and second rollers.

11. The method of claim 8 wherein evaluating the criteria for interchanging includes:

(a) counting the pages advanced by the feed roller (b) subtracting the page count from an estimated separator roller page life.

12. The method of claim 8 wherein evaluating the criteria for interchanging includes:

(a) measuring the sheet slippage of the sheet as the sheet is advanced; and, (b) comparing the sheet slippage to a slippage threshold.

13. The method of claim 8 wherein interchanging the second roller for the first roller and the first roller for the second roller responsive to the evaluated criteria for interchanging includes interchanging the second roller and the first roller after a number of sheets advanced.

14. The method of claim 8 wherein interchanging the second roller for the first roller and the first roller for the second roller responsive to the evaluated criteria for interchanging includes interchanging the second roller and the first roller after a number of print jobs.

15. A sheet feeding system comprising:

(a) first and second parallel rotatable rollers each having first and second ends, the first ends coupled together;

(b) a pick roller configured to acquire a sheet and provide the sheet to the first and second rollers; and, (c) a drive mechanism configured to interchange, in position, the first roller for the second roller and the second roller for the first roller.

16. The system of claim 15 wherein the drive mechanism includes:

(a) a rotatable shaft axially parallel to the first and second rollers and coupled to one of the first and second ends; and, (b) a shaft driver configured to rotate the shaft, rotating the first and second rollers, interchanging, in position, the first roller for the second roller and the second roller for the first roller.

17. The system of claim 15 wherein the drive mechanism includes:

(a) a toothed wheel gear coupled to one of the first and second ends; and, (b) a gear driver configured to drive the gear, interchanging, in position, the first roller for the second roller and the second roller for the first roller.

18. The system of claim 15 wherein the drive mechanism includes:

(a) a pulley wheel coupled to one of the first and second ends;

(b) a belt driver configured to drive the gear, interchanging, in position, the first roller for the second roller and the second roller for the first roller; and, (c) a belt interconnecting the pulley wheel and the belt driver.

19. The system of claim 15 further including a logic processor configured to activate the drive mechanism to interchange, in position, the first roller for the second roller and the second roller for the first roller.

20. The system of claim 15 further including a roller driver for rotating the rollers.

21. The system of claim 15 wherein each of the first and second rollers includes a rolling surface, each rolling surface adjacent the other rolling surface.

* * * * *